US006158876A

United States Patent [19]

Birdwell

[11] Patent Number: 6,158,876

[45] Date of Patent: Dec. 12, 2000

[54] THIRD HAND FOR A FLASHLIGHT HAVING PIVOTAL ARM AND MOUNTING MECHANISM

[76] Inventor: Larry D. Birdwell, 5604 NE. St. Johns Rd., Vancouver, Wash. 98661

[21] Appl. No.: 09/256,813

[22] Filed: Feb. 24, 1999

[51] Int. Cl.[7] ..... F21L 4/00

[52] U.S. Cl. ..... 362/208; 362/389; 362/397; 362/398; 362/191

[58] Field of Search ..... 362/208, 389, 362/396, 397, 398, 190, 191

[56] References Cited

U.S. PATENT DOCUMENTS

| | | | |
|---|---|---|---|
| 1,367,369 | 2/1921 | Friend | 362/191 |
| 1,598,559 | 8/1926 | Cohen | 248/205.6 |
| 1,641,880 | 9/1927 | Cohen | 362/186 |
| 3,325,639 | 6/1967 | King | 362/270 |
| 3,418,461 | 12/1968 | Sedlock | 362/191 |
| 4,399,498 | 8/1983 | Bacevius | 362/396 |
| 4,528,622 | 7/1985 | Bacevius | 362/396 |
| 4,533,982 | 8/1985 | Kozar | 362/183 |
| 4,881,155 | 11/1989 | Gahagan | 362/191 |
| 4,897,768 | 1/1990 | Thul | 362/191 |
| 5,163,752 | 11/1992 | Copeland et al. | 362/396 |
| 5,276,596 | 1/1994 | Krenzel | 362/191 |
| 5,436,815 | 7/1995 | Grooms et al. | 362/216 |
| 5,573,329 | 11/1996 | Van Gennep | 362/191 |
| 5,580,157 | 12/1996 | Patricca et al. | 362/191 |
| 5,593,074 | 1/1997 | Matthews | 224/251 |

*Primary Examiner*—Alan Cariaso
*Assistant Examiner*—Ronald E. DelGizzi

[57] ABSTRACT

A third hand for a flashlight. A flashlight holder adapted for receiving the flashlight that includes provision for stabilizing the flashlight loosely on a support surface or temporarily and releasably attaching the flashlight to a support surface or object. The flashlight holder is pivotally connected to an elongate joint arm at one end thereof, and a mounting mechanism is pivotally connected to the joint arm at the other end thereof. The mounting mechanism includes a variety of attachment devices, and the flashlight holder includes a plurality of stabilizing devices.

10 Claims, 3 Drawing Sheets

THIRD HAND FOR A FLASHLIGHT HAVING PIVOTAL ARM AND MOUNTING MECHANISM

BACKGROUND OF THE INVENTION

This invention relates to a third hand for a flashlight or the like, particularly for adjustably holding the flashlight in a selected one of a plurality of positions and orientations, relieving the hands.

Mechanics, installers, repairpersons and the like commonly have the need to apply portable lighting to their work and, particularly, to aim a beam of light, such as from a flashlight, on a particular portion of the work while the hands remain free to perform operations on the work or to hold tools. It is therefore often desired to adjustably and temporarily fix the flashlight or other light source in space at a particular location and orientation. However, the light must be attached to or rest upon something if it is not held by the worker's hand, and it is not generally the case that the work or site has a specialized provision for this purpose.

A common but inconvenient solution to this problem is for the worker to hold the butt of the flashlight in his or her mouth. A variation on this concept is exemplified by Sedlock, U.S. Pat. No. 3,418,461, wherein a bracket is provided on the flashlight having a mouthpiece for clenching between the user's teeth.

Bacevius, U.S. Pat. No. 4,399,498, provides a clamp housing, one end of which is adapted to receive a flashlight or lantern and the other end of which defines a clamping jaw, and a complementary movable jaw biased with a spring means. The span opening or distance between the gripping jaws can be adjusted for clamping onto surfaces having variable cross sectional shapes. While it is asserted that a wide range of jaw opening is provided, the range of suitable supports remains limited. Moreover, angular adjustment of the direction of the light is also limited in range as well as being limited to one axis.

Thul, U.S. Pat. No. 4,897,768, provides an arcuate track that is mountable with suction cups to a supporting surface. A flashlight is strapped to the track at a selected location and, therefore, inclination. A drawback of the device is that varying the inclination requires two hands for manipulating the strap. Another drawback is that, without removing the suction cups from the support surface, the inclination is adjustable only about one axis. Yet another drawback is that a support surface sufficiently flat and large to receive widely spaced-apart suction cups is required. Van Gennep, U.S. Pat. No. 5,573,329, provides a clamping pliers carrying a ball and socket joint for a flashlight holder. A disadvantage of clamping pliers is that they are generally limited to clamping onto objects that can be gripped with a relatively small jaw opening, and may cause damage to some of objects, particularly if misadjusted.

King, U.S. Pat. No. 3,325,639, provides a base for a high-intensity light. The base includes a suction cup having a magnet secured therein, providing a choice between magnetic and suction mounting. A ball and socket joint is proposed for connecting a pivoting arm of the light to the base. While providing additional flexibility in mounting and movement, the device requires a surface suitable for receiving the magnet or the suction cup, as there are no alternative provisions for supporting the light.

Accordingly, there is a need for a third hand for a flashlight that provides for attachment to, or stabilization upon, a wide variety and range of support objects and surfaces, and provides a wide range of positional and directional adjustability obtained with a minimum of repositioning.

SUMMARY OF THE INVENTION

The present invention solves the aforementioned problems and meets the aforementioned needs by providing a third hand for a flashlight comprising a flashlight holder adapted for receiving the flashlight that includes provision for stabilizing the flashlight loosely on a support surface or temporarily and releasably attaching the flashlight to a support surface or object. The flashlight holder is pivotally connected to an elongate joint arm at one end thereof, and a mounting mechanism is pivotally connected to the joint arm at the other end thereof. The mounting mechanism comprises a variety of attachment devices including a suction cup, a magnet and a threaded member. The flashlight holder comprises a plurality of stabilizing devices including one or more pivotally connected leg members.

Preferably, the back surface of the suction cup is spring biased against the end of the mounting mechanism, and the end of the mounting mechanism is adapted to bear against the back surface at points spaced along the outer periphery thereof, to provide maximum stiffness in the joint formed between the mounting mechanism and the flexible suction cup.

Accordingly, it is a principal object of the present invention to provide a novel third hand for a flashlight.

It is another object of the present invention to provide a third hand for a flashlight that provides attachment to, or stabilization upon, a wide variety and range of support objects and surfaces.

It is yet another object of the present invention to provide a third hand for a flashlight that provides a wide range of positional and directional adjustability.

It is still another object of the present invention to provide a third hand for a flashlight that provides a wide range of positional and directional adjustability with a minimum of repositioning.

The foregoing and other objects, features and advantages of the invention will be more readily understood upon consideration of the following detailed description of the invention, taken in conjunction with the following drawings.

DETAILED DESCRIPTION OF A PREFERRED EMBODIMENT

Figures 1, 2:
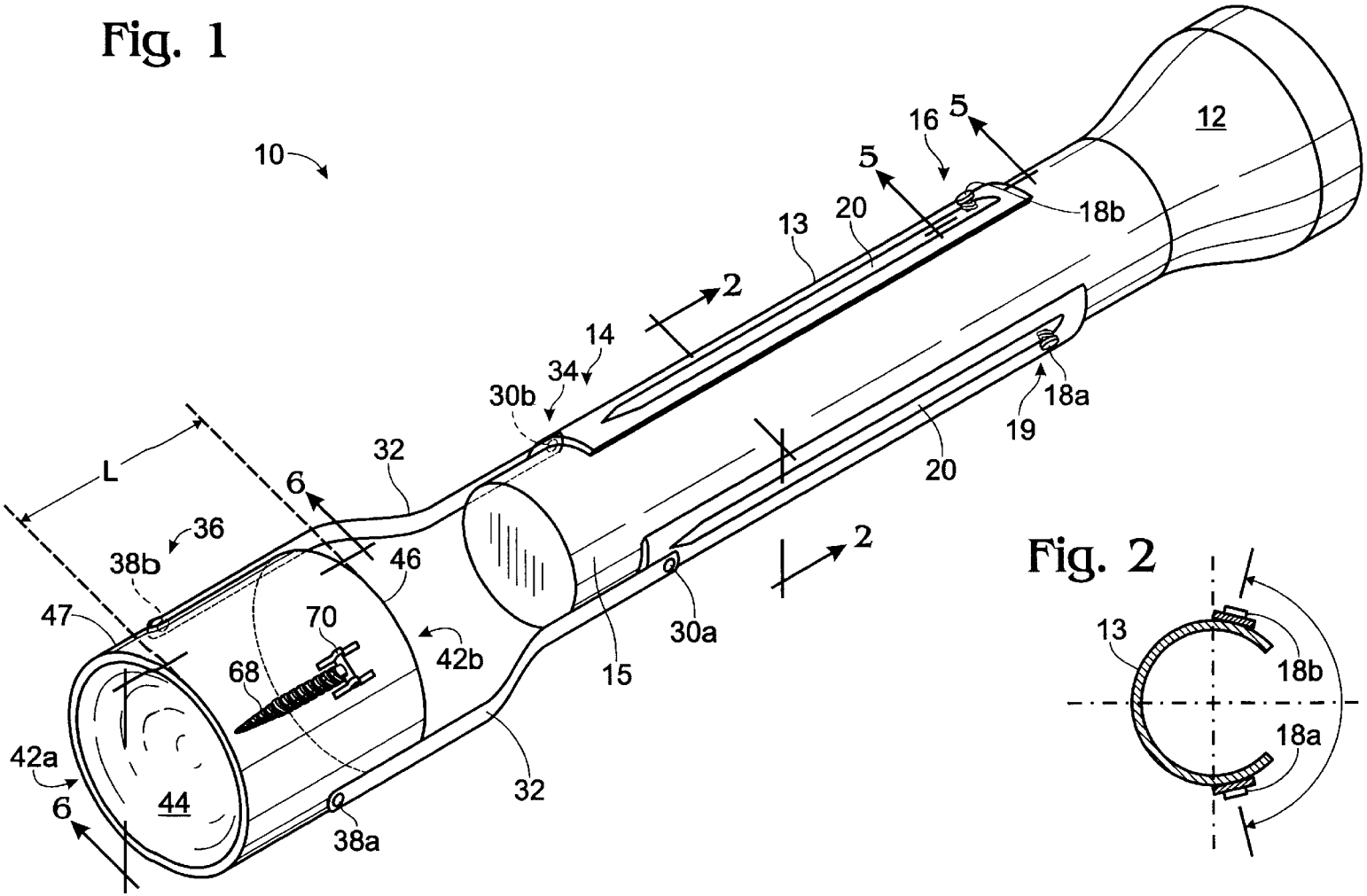
FIG. 1 is a pictorial view of a third hand for a flashlight according to the present invention in a first configuration, with legs thereof in a stowed position.
FIG. 2 is a sectional view of the third hand of FIG. 1, taken along a line 2—2 thereof.

FIG. 1 depicts a third hand 10 for a flashlight 12 according to the present invention. As will be apparent from the disclosure below, the third hand 10 is capable of being configured for holding the flashlight in a wide range of positions and orientations, only one of which is shown in FIG. 1. A preferred flashlight 12 is marketed by Mag Instrument, Inc. of Ontario, Calif. under the trademark MAG-LITE ("MagLite"). The MagLite has a cylindrical body portion adapted for gripping by the user; however, it will be understood that the third hand 10 may be employed with flashlights or other lights having other configurations or cross-sectional shapes as well.

Referring to FIG. 1, the third hand 10 has a flashlight holder 14 that is adapted for receiving the flashlight 12. For the MagLite, the flashlight holder has a semi-cylindrical body portion 13 adapted to conform to the cylindrical body 15 of the light. The flashlight holder may be formed of any suitable material and is preferably metal or plastic.

The flashlight holder 14 includes, at one end 16 thereof, two pivot joints 18*a* and 18*b* projecting radially from the holder. Referring to FIG. 2, it is preferable that the joints 18*a* and 18*b* are not diametrically opposed to one another, i.e., they are less than 180 degrees apart from one another, though this is not an essential feature of the invention.

Figure 3:
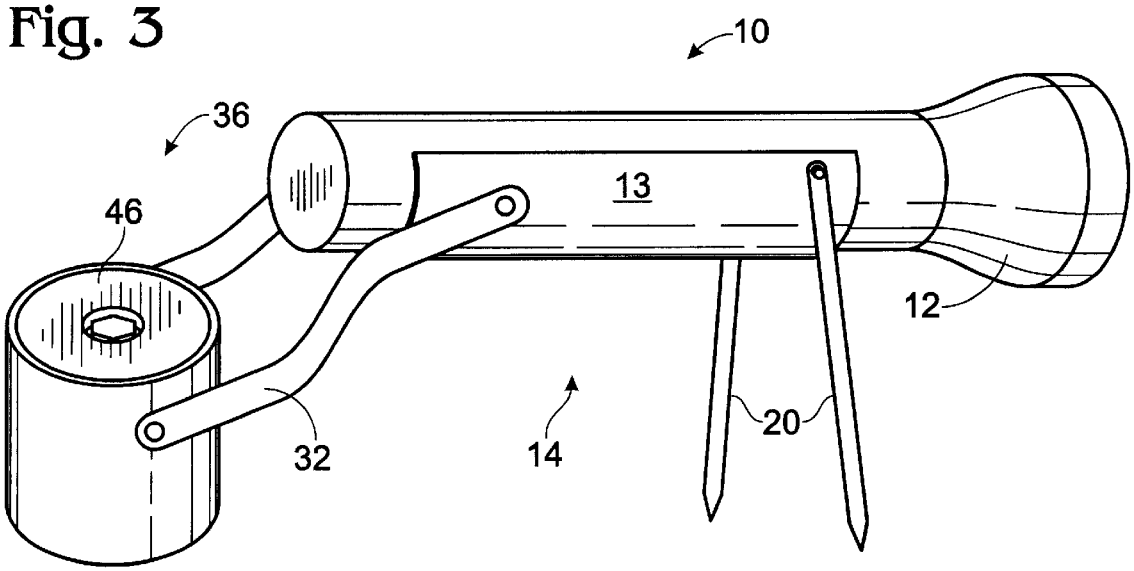
FIG. 3 is a pictorial view of the third hand of FIG. 1, showing the legs in an open position.

The joints 18*a* and 18*b* are adapted to receive respective stabilizing devices, particularly respective ends 19 of two elongate legs 20. The legs are independently pivotal at the joints between a stowed position, as shown in FIG. 1, wherein the legs lie substantially flush along the body of the flash-light holder, to an open position, shown in FIG. 3, wherein the legs project away from the flash-light holder. The legs in combination with the flash-light and flashlight holder preferably form a tripod in the open position. The stance of the tripod so formed is enlarged because the legs splay outwardly from one another in their open positions, due to the aforementioned asymmetry of the position of the joints 18*a* and 18*b*.

Figure 5:
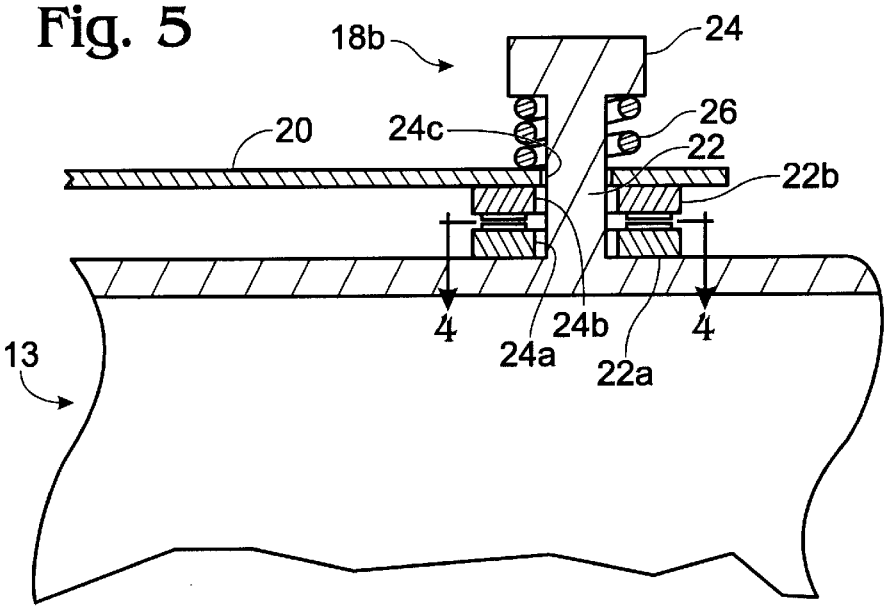
FIG. 5 is a sectional view of the third hand of FIG. 1, taken along a line 5—5 thereof.
Figure 4:
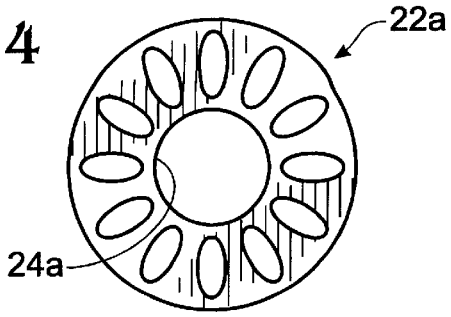
FIG. 4 is a plan view of a ribbed washer for use with the present invention.

The joints 18*a* and 18*b*, though permitting the legs 20 to pivot, should also to some extent resist pivoting so that they maintain their selected positions under the weight of the third hand loaded with the flashlight 12. A simple friction joint may be employed; however, a preferred embodiment of the joints 18*a* and 18*b* employs two ribbed washers for each joint. A plan view of a ribbed washer 22*a* is shown in FIG. 4. Turning to FIG. 5, one of two similar ribbed washers 22*a* and 22*b* is fixedly attached to the end 16 of the flashlight holder, and the other of the washers is fixedly attached to the end 19 of the leg 20. By way of illustration but not of limitation, for plastic parts 14 and 20, the ribbed washers may be insert molded therein and, for metal parts 14 and 20, the ribbed washers may be spot welded, soldered or brazed thereto or thereon.

A post 22 extends from the body portion 13 of the flashlight holder through apertures 24*a*, 24*b* and 24*c* respectively in the washers and in the leg 20. The post 22 has a cap 24 that captures a compression spring or spring washer 26 for biasing the ribbed washers together. The ribbed washers provide for a two-way ratcheting action that holds the legs firmly in a selected one of a number of discrete positions.

Referring back to FIG. 1, an opposite end 28 of the flashlight holder 14 employs two pivot joints 30*a* and 30*b* for pivotally attaching respective elongate joint arms 32 to the flashlight holder. The arms are attached to the flashlight holder at ends 34 thereof. The pivot joints 30*a* and 30*b* are similar to the joints 18*a* and 18*b* and preferably employ the ribbed washer construction described above in connection with FIG. 3.

A mounting mechanism 36 is provided for carrying a plurality of attachment devices. The mounting mechanism is shown with a circular shape, however, this is not a functional requirement. The mounting mechanism includes two pivot joints 38*a* and 38*b* for pivotally attaching the arms 32 at ends 40 thereof. The pivot joints 38*a* and 38*b* are similar to the joints 18*a* and 18*b* and preferably employ the ribbed washer construction described above in connection with FIG. 3. The joints 30*a*, 30*b*, 38*a* and 38*b* provide a compound linkage between the flashlight holder 14 and the mounting mechanism 36, permitting an exceptionally high degree of adjustment of the inclination and position of the flashlight holder with respect to the mounting mechanism.

The arms 32 are sufficiently long, with respect to the length "L" of the mounting mechanism, to permit the mounting mechanism to be pivoted over 360 degrees about the joints 38*a* and 38*b* without interfering with the flashlight 12 when it is in the flashlight holder 14. This provides for either of two ends 42*a*, 42*b* of the mounting mechanism to be oriented away from the flashlight 14.

As one of the attachment devices, a suction cup 44 is attached at one of the ends 42*a* of the mounting mechanism 36. As another of the attachment devices, a magnet 46 is attached to the other end 42*b* of the mounting mechanism. As yet another of the attachment devices, a threaded member 68 is attached to a side 42*c* of the mounting mechanism.

Figure 6:
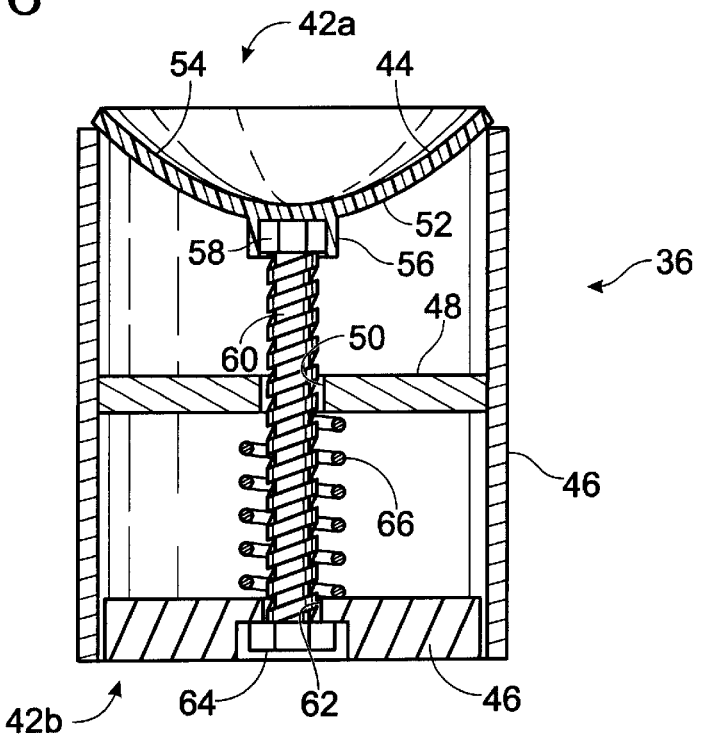
FIG. 6 is a sectional view of the third hand of FIG. 1, taken along a line 6—6 thereof, showing a suction cup in a relaxed and fully biased position.

The magnet 46 may be obtained as a standard product available through hardware stores, such as that marketed by Master Magnetics, Inc. of Castle Rock, Colo., under the trademark THE MAGNET SOURCE. Referring to FIG. 6, the magnet includes an aperture 62 therethrough for mounting the magnet to the mounting mechanism 36.

The suction cup 44 may also be obtained as a standard product available through hardware stores, such as that marketed by W.C. Winks Hardware of Portland, Oreg. The suction cup includes a base portion 56 in which a nut or a bolt 58 is fixedly installed for mounting the suction cup to the mounting mechanism. The suction cup 44 and magnet 46 may be simply fixedly attached to the respective ends 42*a* and 42*b*, extending therefrom. However, additional advantages may be obtained with the structure described next. The mounting mechanism has a housing 47, and a landing 48 is preferably disposed within the housing which divides the housing between the ends 42*a* and 42*b*. The landing includes an aperture 50 therethrough. By way of illustration but not of limitation, for a plastic mounting mechanism, the housing and landing may be molded together, and for a metal housing, the landing may be a washer welded, soldered or brazed therein.

The suction cup has a back surface 52 and a front surface 54 that are, respectively, convex and concave when the suction cup is in its relaxed, as-molded configuration. A threaded member 60, such as a machine screw, extends through the aperture 50 in the landing toward the end 42*a* and is threaded into the nut 58 of the suction cup, capturing the suction cup on the side of the landing proximate the end 42*a*. The threaded member 60 is also passed through the aperture 62 in the magnet 46, and has a cap 64 that is larger than the aperture 62 so that the magnet is captured on the side of the landing proximate the end 42*b*. The movable assembly formed by the threaded member 60, the suction cup 44 and the magnet 46 is spring biased with a compression spring 66 toward the end 42*b* relative to the end 42*a*. The movable assembly is moved, by pressing the magnet toward the landing, to extend the suction cup for use. Certain conditions desirable for providing this feature and for taking advantage of it are described next. The diameter of the mounting mechanism 36 at the end 42*b* is preferably larger than the diameter of the magnet 46, so that the end 42*b* may receive the magnet when the magnet is depressed toward the landing 48, extending the suction cup 44 away from the end 42*a*. However, the magnet may extend from the end 42*b* when the movable assembly is in its fully biased position, and therefore be any size, without departing from the principles of the invention.

Figure 7:
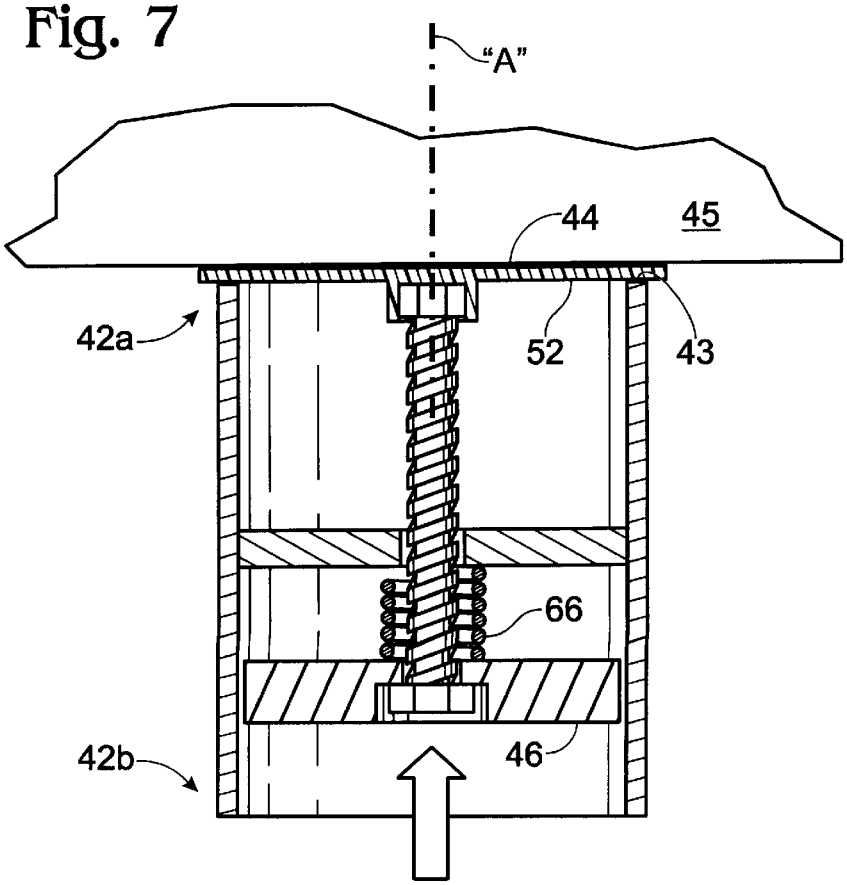
FIG. 7 is a sectional view of the third hand of FIG. 1, taken along the line 6—6, showing a suction cup attached to a mounting surface.

Preferably, the threaded member 60 is adapted in length so that the suction cup in its relaxed configuration is at least partially withdrawn inside the end 42*a* when the movable assembly is in its fully biased position. Referring to FIG. 7, the movable assembly may be pressed against the spring bias to extend the suction cup from the end 42*a*, flattening the suction cup against a support surface 45 to obtain suction. The outer periphery of the suction cup 44 is preferably at least slightly larger than the diameter of the mounting mechanism 36 at its end 42*a*, when the suction cup is in its flattened configuration. This provides for an outstanding advantage. Upon releasing the movable assembly, an edge portion 43 of the end 42*a* is forced to bear against the back surface 52 near the outer periphery of the suction cup by the spring bias. This protects the surface on which the suction cup is mounted from damage by the mounting mechanism, and at the same time provides a relatively large moment for resisting bending induced separation between the suction cup and the mounting mechanism 36.

The movable assembly also permits rotating the mounting mechanism and, therefore, the flashlight holder, about the elongate axis "A" of the threaded member 60 so that, when either the magnet or the suction cup is attached to the surface 45, the flashlight holder may be rotated about an axis perpendicular to the surface without detaching the magnet or suction cup from the surface. This movement in conjunction with pivoting at the joints 30*a*, 30*b*, 38*a* and 38*b*, provides an outstanding range of motion for adjusting the orientation and position of the flashlight, all while the third hand is temporarily attached to the surface 45. Referring back to FIG. 1, the side 42*c* of the mounting mechanism 36 employs a pivot joint 70 for pivotally attaching the threaded member 68, which may be a sheet metal screw, to the mounting mechanism. The pivot joint 70 is similar to the joints 18*a* and 18*b* and preferably employs the ribbed washer construction described above in connection with FIG. 3. However, the pivot joint 70 employs two lugs 72 extending from the side 42*c*. By way of illustration but not of limitation, the lugs may be molded or cast in the mounting mechanism, or joined therewith, such as by welding. The threaded member may be extended for screwing into an available wood surface or support, where that is desirable.

The third hand 10 provides the capability to position and aim the flashlight 12 freely with respect to the most effective mechanism for attachment or stabilization under a given set of conditions. The mounting mechanism 36 may be pivoted about the pivot joints 38*a* and 38*b* and, independently, the arms 32 may be pivoted about the pivot joints 30*a* and 30*b*, pivoting the mounting mechanism about the body portion 13 of the flashlight holder. Moreover, the various stabilizing and attachment devices may also be independently manipulated into a variety of positions, by pivoting the legs about the pivot joints 18*a* and 18*b*, translating or rotating the movable assembly with respect to the mounting mechanism, and pivoting the threaded member 68 about the pivot joint 70.

As just one example of the range of positional and orientational flexibility provided by the third hand, two legs 20 in their open position provide two points of a tripod for stabilizing the flashlight holder on a support surface as was discussed above. The third point of the tripod, however, may be one of a number of choices selected by particularly configuring the third hand. For example, the arms 32 could be pivoted about the pivot joints 30*a* and 30*b* to move the mounting assembly out of the way so that the end of the flashlight body would provide the third point of the tripod. Alternatively, the arms could be pivoted so as to employ the mounting assembly as the third point of the tripod. A particular point on the mounting assembly could further be selected by pivoting the mounting assembly about the pivot points 38*a* and 38*b*. All of these different choices provide for differing heights and stances for the tripod, which can be combined with variations in the position of the legs to obtain innumerable configurations for a tripod for holding the flashlight under the widest range of conditions. It should be apparent from this example, and from all of the foregoing, that the third hand provides for attachment to, or stabilization upon, a wide variety and range of support objects and surfaces, and provides a wide range of positional and directional adjustability with a minimum of repositioning.

It is to be recognized that, while particular third hand for a flashlight according to the present invention has been shown as preferred, other configurations could be utilized, in addition to configurations already mentioned, without departing from the principles of the invention.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims that follow.

I claim:

1. A third hand for a light, comprising:

a holder adapted for holding the light;

a mounting mechanism including a plurality of attachment devices adapted for removably attaching the mounting mechanism to a support; and at least one arm pivotally attached to said holder at a first end of said arm, said arm being pivotally attached to said mounting mechanism at a spaced apart second end of said arm.

2. The apparatus of claim 1, wherein said arm is pivotally attached to said mounting mechanism so as to permit said mounting mechanism to pivot more than 360 degrees with respect to said arm.

3. The apparatus of claim 1, further comprising at least two legs pivotally attached to the flashlight holder at respective first ends of said legs.

4. The apparatus of claim 3, wherein said legs are pivotally attached to the flashlight holder so that respective second ends of said legs are moved farther apart from one another when said legs are pivoted together so as to extend farther away from the flashlight holder.

5. The apparatus of claim 1, wherein said mounting mechanism has two ends, wherein said arm is pivotally attached to said mounting mechanism between said two ends of said mounting mechanism, and where a suction cup is disposed at one of said ends of said mounting mechanism and wherein a magnet is disposed at the other of said ends of said mounting mechanism.

6. The apparatus of claim 5, wherein said magnet and said suction cup are attached together and spring biased so that, in a fully biased position of said suction cup, said suction cup is at least partially inside said one of said ends of said mounting mechanism and so that pressing said magnet toward said one of said ends of said mounting mechanism extends said suction cup away from said one of said ends of said mounting mechanism.

7. The apparatus of claim 5, wherein said suction cup has an outer periphery that is larger than the outer periphery of said one of said ends of said mounting mechanism when said suction cup is flattened.

8. The apparatus of claim 7, wherein said outer periphery of said suction cup is slightly larger than the outer periphery of said one of said ends of said mounting mechanism when said suction cup is flattened.

9. The apparatus of claim 1, further comprising a threaded member pivotally attached to a side of said mounting mechanism.

10. The apparatus of claim 1, wherein said arm is pivotally attached to said mounting mechanism so as to permit said mounting mechanism to pivot at least 360 degrees with respect to said arm.

* * * * *